US006851585B2

(12) United States Patent
Wrigley

(10) Patent No.: US 6,851,585 B2
(45) Date of Patent: Feb. 8, 2005

(54) SELF-CLOSING LEVER TAP

(75) Inventor: Andrew Wrigley, Auckland (NZ)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/678,953

(22) Filed: Oct. 3, 2003

(65) Prior Publication Data

US 2004/0108341 A1 Jun. 10, 2004

Related U.S. Application Data

(63) Continuation of application No. PCT/NZ02/00045, filed on Mar. 28, 2002.

(30) Foreign Application Priority Data

Apr. 4, 2001 (NZ) ..... 510957

(51) Int. Cl.[7] ..... B67D 3/00

(52) U.S. Cl. ..... 222/505; 222/153.06; 222/153.14; 222/517

(58) Field of Search ..... 222/505, 517, 222/153.06, 153.14

(56) References Cited

U.S. PATENT DOCUMENTS

| | | | | | |
|---|---|---|---|---|---|
| 4,211,348 | A | * | 7/1980 | Scholle | 222/498 |
| 4,386,720 | A | | 6/1983 | Speedie | 222/498 |
| 4,621,750 | A | | 11/1986 | Roethel | 222/505 |
| 4,623,077 | A | * | 11/1986 | Swartzbaugh | 222/517 |
| 4,711,380 | A | | 12/1987 | Ulm | 222/541 |
| 4,927,061 | A | | 5/1990 | Leigh et al. | 222/212 |
| 5,797,524 | A | * | 8/1998 | Lentz | 222/505 |
| 6,003,742 | A | * | 12/1999 | Garcia et al. | 222/517 |

FOREIGN PATENT DOCUMENTS

| | | |
|---|---|---|
| EP | 0 194 412 A1 | 1/1986 |
| EP | 0 194 412 A3 | 9/1986 |

* cited by examiner

*Primary Examiner*—Philippe Derakshani
(74) *Attorney, Agent, or Firm*—Mark W. Croll; Paul F. Donovan

(57) ABSTRACT

A valve particularly suitable for use on disposable containers has a valve head on a flexible membrane. A simple lever moves the valve head to open the valve and deform the membrane. The shape of the membrane returns the valve head to a closed position upon release of the lever. Structure for restricting movement is provided for preventing excessive deflection of the membrane.

23 Claims, 3 Drawing Sheets

SELF-CLOSING LEVER TAP

CROSS-REFERENCE TO RELATED APPLICATIONS

The present application is a continuation of International Application Number PCT/NZ02/00045, filed on 28 Mar. 2002.

FIELD OF THE INVENTION

The present invention relates to container valves. Specifically the valve of the present invention may be used in so-called "bag-in-a-box " fluid dispensing applications where it is of advantage to have a self-closing valve or tap assembly, which can be operated easily, and quickly by a user.

BACKGROUND OF THE INVENTION

Numerous different types of valves and taps have been developed and used to dispense a wide range of fluids from various containers. One common application for taps and valves is "bag-in-a-box " products in which a bladder is provided within a cardboard box, and a low cost, disposable tap is provided to dispense fluid from the bladder.

In bag-in-a-box products the valve assembly provided needs to be formed inexpensively from low cost materials allowing the whole packaging assembly to be discarded once the contents of the bladder has been dispensed. Of course, the valve must still operate effectively, to tightly close and prevent spills or leakage even after long periods of use with frequent or infrequent opening and closing cycles.

One problem associated with such tap or valve assemblies is the ease with which they can be used to dispense fluid from the disposable bladder. Some of the known designs require the use of several fingers of one or both hands to operate an actuation button or lever efficiently. Some designs require the user's hands to be placed in an awkward position. Furthermore, some of these assembles also require a separate movement from the user to close the tap or valve in addition to the first movement to open the valve. This, too, can be awkward, requiring repositioning of the user's hand and increasing the risk of accidental spilling or overflowing the container being filled from the dispenser. It is also possible that the user may not completely close the valve, resulting in intermittent dripping of fluid from the valve.

A valve or tap assembly that improves on the above disadvantages and problems would be of advantage. A valve or tap assembly that can be operated by one or two fingers only, and that closes automatically when the user's hands or fingers are not in contact with the assembly would be of advantage.

The present invention addresses the foregoing problems and provides the public with a useful choice.

SUMMARY OF THE INVENTION

The present invention provides a valve having an elastomeric component operated by a simple lever requiring only single action for opening and automatic return to a closed position upon release of the lever.

In one aspect thereof, the present invention provides a valve with a body defining a fluid channel including a first open end forming an inlet to the channel and a valve seat within the body defining an outlet in fluid communication with the channel. A valve head is adapted to engage the valve seat to close the outlet from the fluid channel. A lever connected to the valve head is adapted to pivot the valve head toward the valve seat to close the valve and to pivot the valve head away from the valve seat to open the valve upon movement of the lever. A movement restricter connected to the body is positioned to restrict movement of the valve head in the direction to open the valve.

In another aspect thereof, the present invention provides a valve with a hollow body defining a fluid channel including a first open end forming an inlet to the channel and a valve seat within the body at a second end thereof defining an outlet in fluid flow communication with the channel. A lever is pivotally connected to the body. A valve membrane of flexible material defines a valve head therein adapted to engage the valve seat to close the outlet from the fluid channel. The valve membrane is connected to and forms a fluid tight seal between the body and the lever. The valve head and the lever are associated to pivot the valve head toward the valve seat to close the valve and to pivot the valve head away from the valve seat to open the valve upon movement of the lever. A movement restricter is connected to the body and positioned to restrict movement of the valve head in a direction to open the valve.

In still another aspect thereof, the present invention provides a valve with a hollow body defining a fluid channel including a first open end forming an inlet to the channel and a valve seat within the body at a second end thereof defining a downwardly opening outlet in fluid flow communication with the channel. A lever is pivotally connected to the body. A valve membrane of flexible material defines a valve head therein adapted to engage the valve seat to close the outlet from the fluid channel. The valve membrane is connected to and forms a fluid tight seal between the body and the lever. The valve head and the lever are operatively associated to pivot the valve head toward the valve seat to close the valve and to pivot the valve head away from the valve seat to open the valve upon movement of the lever. The valve membrane is formed in a shape having memory, and is positioned on the body for deflection from the shape to open the valve upon movement of the lever and for returning to the shape for closing the valve upon release of the lever. A cap connected to the body substantially covers the valve membrane, and has a portion thereof positioned to restrict movement of the valve head in a direction to open the valve.

An advantage of the present invention is providing a fluid-dispensing valve that can be operated easily and comfortably, and that closes automatically when not operated for opening.

Another advantage of the present invention is providing a fluid-dispensing valve that can be manufactured using relatively low cost materials and manufacturing techniques for use on disposable packaging applications.

Still another advantage of the present invention is providing a fluid-dispensing valve that has tamper-evident structures providing a visible indicator when the seal has been breached.

Other features and advantages of the invention will become apparent to those skilled in the art upon review of the following detailed description, claims and drawings in which like numerals are used to designate like features.

Figure 1:
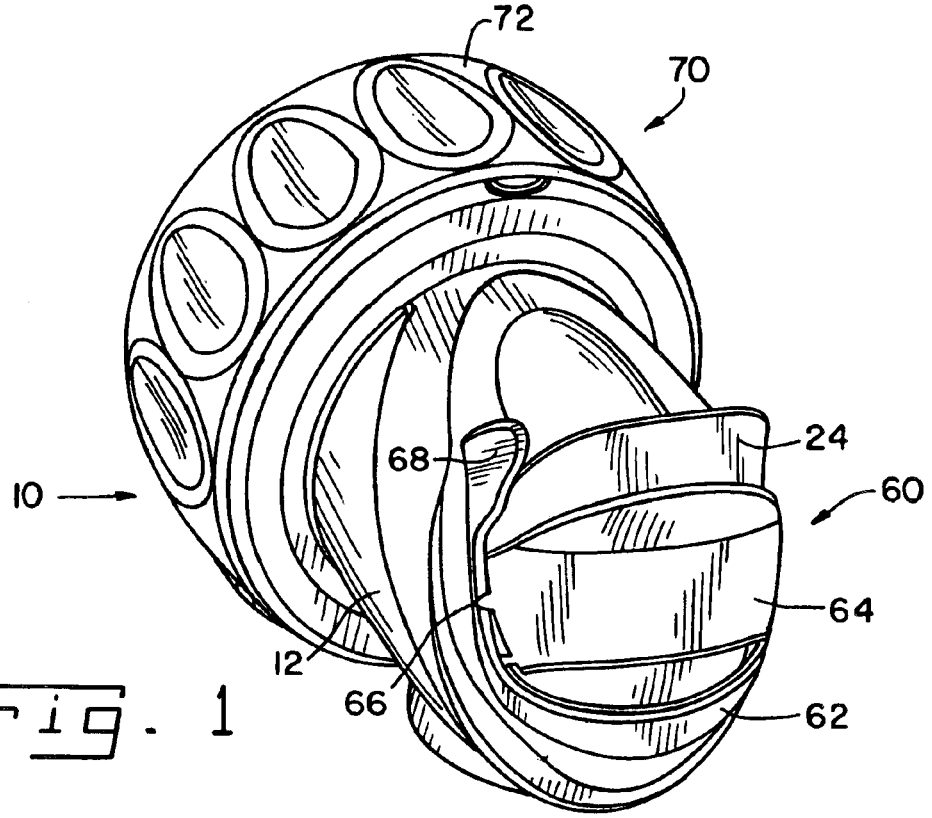
FIG. 1 is a perspective view of a self-closing valve in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including" and "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings, FIG. 1 is a perspective view of a valve assembly 10 configured in accordance with a preferred embodiment of the present invention. Valve assembly 10 can be used for dispensing liquids from a variety of packages or containers, including but not limited to bag-in-a-box type packages. Reference throughout this specification will be made to the present invention being used in a bag-in-a-box application, but those skilled in the art should appreciate that other applications for the invention are also considered. For example, in one embodiment one end of the valve assembly may be provided with a male or female-thread connection system to allow it to be engaged with other components of a fluid delivery or dispensing apparatus.

Valve assembly 10 is formed from a main body 12 that is substantially hollow and defines or forms a channel 14 through which fluid can flow from a package (not shown) on which valve assembly 10 is installed. Fluid can flow from the container into valve assembly 10 through a first or inner end 16 of the body 12 that is open into the container and defines an inlet to the valve. Fluid flows out from valve assembly 10 through a downwardly opening valve seat 18 in a second or outer end 20 of body 12, seat 18 being in fluid flow communication between channel 14 and the outside of valve assembly 10, and thereby defining a valve outlet.

A valve head 22 is provided to open and close the outlet from channel 14.

Preferably, valve head 22 has a non-drip profile for engagement with valve seat 18. Valve head 22 can pivot into engagement with valve seat 18 to close the outlet from channel 14 and can pivot away from valve seat 18 to open the channel 14. The form and configuration of valve head 22 may be arranged so as to seal tightly the end of fluid channel 14 by engaging with the edges or rim of the valve seat 18.

Figure 2:
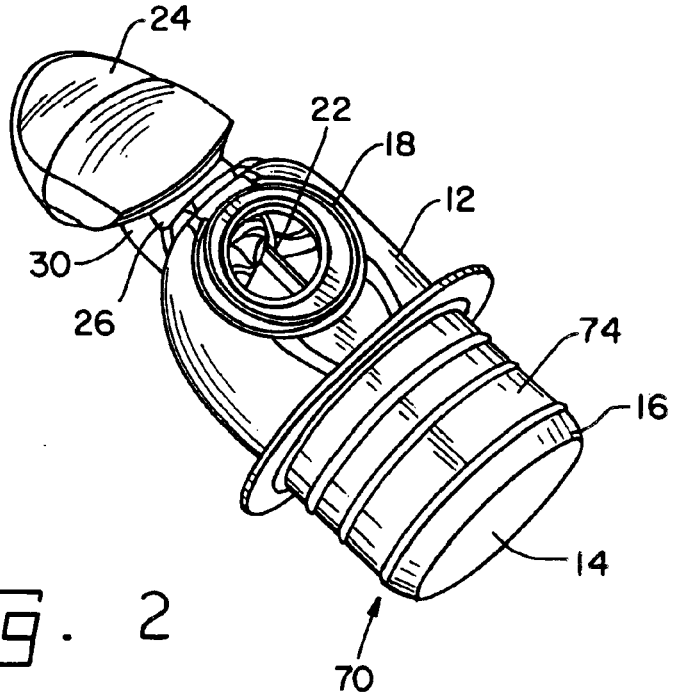
FIG. 2 is a perspective view of the underside of a valve in accordance with the present invention, with some structures removed and the valve shown in an opened position.
Figure 3:
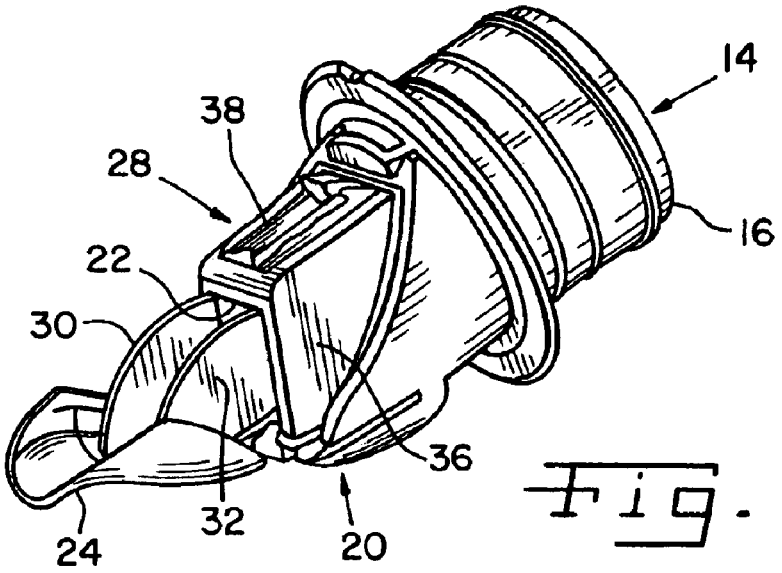
FIG. 3 is a perspective view of the valve of FIG. 2, but shown from the top of the valve.

A trigger lever 24 is connected to body 12 and to valve head 22, and is used by an operator of the valve to pivot valve head 22 toward and away from valve seat 18. Lever 24 is shown in FIGS. 2, 3 and 4 in a position where valve head 22 is pivoted away from the valve seat 18 to open fluid channel 14 from the body 12, allowing fluid to pass out of valve assemble 10.

In a preferred construction, valve body 12 and lever 24 are cast as an integral body of relatively rigid material, such as food-safe plastic if valve assembly 10 is to be used for dispensing beverages or other fluids for human consumption. A hinge 26 of thin plastic material is formed as the interconnection between lever 24 and body 12, allowing pivoting movement of lever 24 relative to body 12.

Valve head 22 is part of a valve membrane 28 formed of flexible, preferably somewhat elastic, food-safe material if valve assembly 10 is to be used for dispensing beverages or other fluids for human consumption. Valve membrane 28, including valve head 22 can be formed by overmolding on main body 12 and trigger lever 24, and serves as an end enclosure of fluid channel fluid 14, completely sealing the area between body 12 and lever 24 in a fluid-tight manner. Valve head 22 is a formed, thickened structure shaped to sealingly engage valve seat 18 when valve assembly 10 is in a closed position. Wings 30 and 32 are provided from lever 24 and are secured to valve head 22 on opposite sides thereof, for proper positioning of head 22 in valve seat 18 when lever 24 is in a closed position. Valve membrane 28 further includes lateral flanks 34 and 36 and a top 38 each extending from valve head 22 to body 12.

Figure 4:
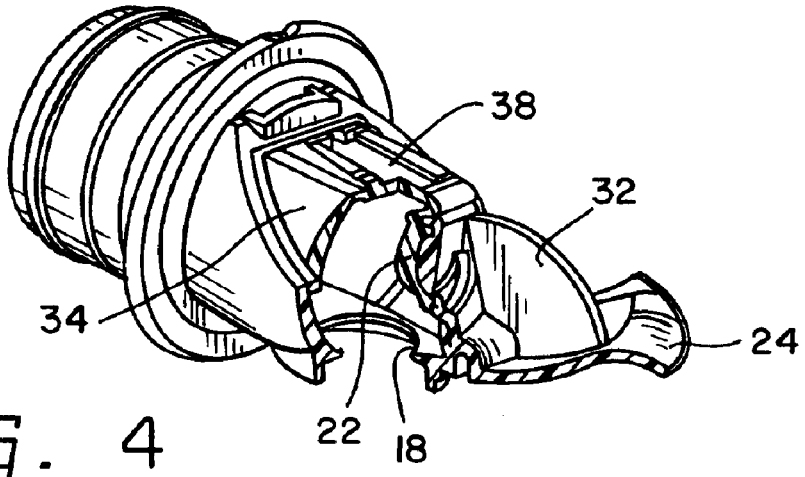
FIG. 4 is a perspective, partial cut-away view of the valve in FIG. 3, shown from the opposite side and revealing internal structures of the valve.

The interaction of valve seat 18 and valve head 22 can be best understood with reference to the cutaway view shown in FIG. 4. Elastic valve membrane 28 can flex to pivot valve head 22 in and out with respect to the valve seat 18. Valve membrane 28 is provided in a shape having memory. Thus, when valve head 22 is pivoted away from seat 18, the cooperative shapes of flanks 34 and 36, and top 38 of elastic membrane 28 provide a biasing force to resist motion of lever 24 pivoting head 22 away from seat 18. When the user releases lever 24, the biasing force provided through elastic membrane 28 pulls and pivots valve head 22, to move back into engagement with valve seat 18, to close fluid channel 14 formed within the valve body 12.

Trigger lever 24 is operated easily by a user of valve assembly 10. Through a force applied by one or two fingers, lever 24 can be pulled outwardly and down by a user, to open valve assembly 10. Conversely, to close valve assembly 10, the user simply pushes the lever 24 in the opposite direction or by simply releasing the trigger lever 24, the biasing force applied by elastic membrane 28 will pull valve head 22 back into engagement with valve seat 18.

It should be understood that pivoting lever 24 to the extreme positions shown in FIGS. 2–4 is not required to open valve assembly 10 and allow fluid to pass therethrough. The extreme positioning of lever 24 is shown in FIGS. 2–4 to better reveal the internal parts of valve assembly 10, and to explain the operation thereof. During use and operation of valve assembly 10, valve membrane 28 is inwardly folded rather than outwardly folded, as shown in FIGS. 2–4. If opened to the outwardly folded, extreme position shown in FIGS. 2–4, the biasing force from the shape and elasticity of membrane 28 may be insufficient to close valve assembly 10 automatically.

A rigid cap 50 is provided to cover at least a portion if not substantially all of the exposed outer surfaces of membrane 28. Cap 50 includes a ring 52 that is attachable to body 12, surrounding lever 24 at the base thereof. A tab 54 is connected to and extends inwardly in ring 52. Tab 54 restricts outward movement of membrane 28 and specifically outward movement of valve head 22 thereof. Tab 54 thereby ensures that membrane 28 remains at least partially inwardly folded and is not completely outwardly folded.

Figure 5:
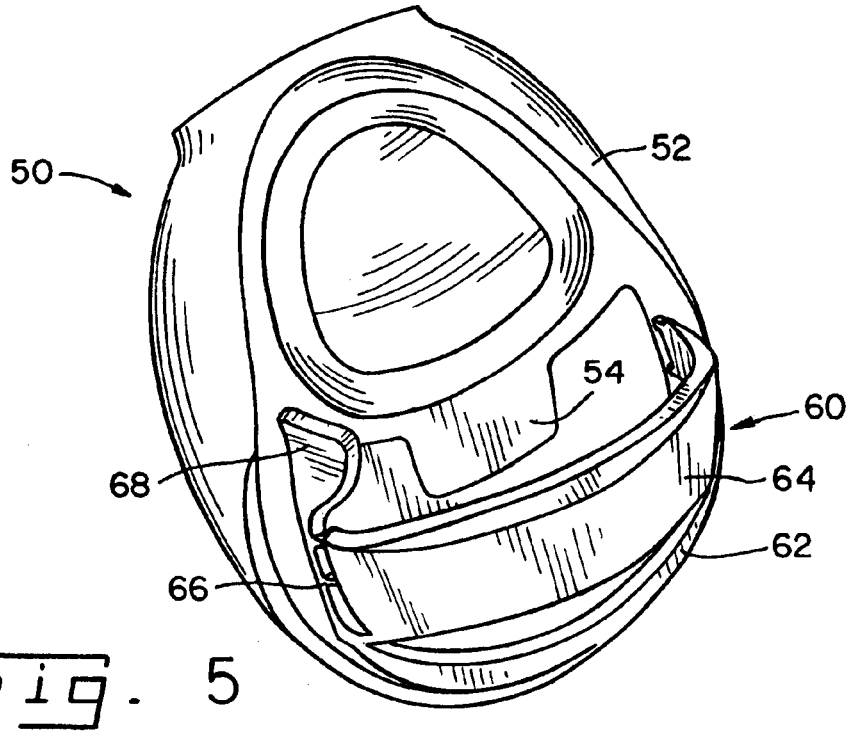
FIG. 5 is a perspective view of the cap and tamper-proof seal of the valve shown in FIG. 1, but removed for clarity and illustration in FIGS. 2–4.

A tamper-evident seal 60 is incorporated with cap 50, and includes an inner strap 62 and outer blocking member 64 positioned closely to or against lever 24. FIG. 5 shows cap 50 and tamper evident seal 60 apart from body 12.

FIG. 1 shows valve assembly 10 before use, with tamper-evident seal 60 in place thereon. Tamper-evident seal 60 is connected weakly to cap 50 by frangible links 66. In the exemplary embodiment, frangible links 66 are provided between inner strap 62 and ring 52. Inner strap 62 can be provided with a handle 68, which can be grasped and pulled or twisted to break frangible links 66 and remove tamper-evident seal 60 when valve assembly 10 is placed into use for dispensing fluid from a container on which it is installed.

Valve assembly 10 can not be opened without fracturing one or more frangible link 66. Any tampering with trigger level 24 will break one or more frangible link 66, thereby providing a visual indication of tampering. Additionally, tamper-evident seal 60 provides a level of security against accidental opening of valve assembly 10 during transportation and/or handling of a container in which valve assembly 10 is installed.

FIGS. 2–4 show perspective views of a valve that differs from that of FIG. 1 only with respect to a connector 70 used for attaching valve assembly 10 to a container or package on which it is used. Connector 70 also can be adapted to allow valve 10 to be connected to fluid supply lines or fluid distribution networks and to dispense fluid from such networks easily. For example, connector 70 may be formed from a female threaded component 72 as shown in FIG. 1. Connector 70 also can include a male component 74 that is inserted into a container, and may include threads or ribs 76 for securing attachment of valve assembly 10 to the container.

Figure 6:
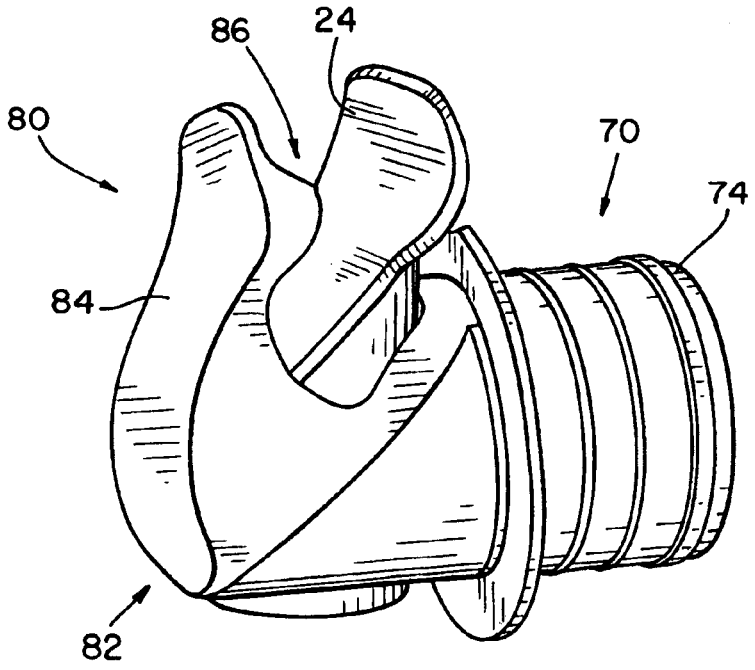
FIG. 6 is a perspective view of another embodiment of the present invention.

FIG. 6 illustrates a further embodiment of a valve assembly 80 of the present invention in which a cap 82 is rigidly connected to, and preferably formed integrally with main body 12. Cap 82 includes an outer wall 84 positioned outwardly of lever 24 and essentially defines a pocket 86 in which lever 24 can operate. The internal structures of valve assembly 80 are substantially as shown and described previously herein, and include a valve membrane 28 with a valve head 22 operating in conjunction with valve seat 18 and lever 24 to open and close valve assembly 80. Valve assembly 80 is operated easily by grasping lever 24 and outer wall 84 between a thumb and forefinger on one hand, and pinching to move lever 24 toward wall 84, thereby opening valve 80. Since outward movement of lever 24 is restricted by wall 84, membrane 28 is not deformed excessively, and the shape and elasticity thereof returns valve assembly 80 to a closed position upon release of lever 24.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A valve comprising:

a body defining a fluid channel including a first open end forming an inlet to said channel;

a valve seat within said body, said valve seat defining an outlet in fluid communication with said channel;

a valve head adapted to engage said valve seat to close said outlet from said fluid channel;

a lever connected to said valve head and adapted to pivot said valve head toward said valve seat to close said valve and to pivot said valve head away from said valve seat to open said valve upon movement of said lever; and a substantially rigid movement restricter connected to said body and positioned to restrict movement of said valve head in a direction for opening said valve.

2. The valve of claim 1, said lever formed integrally with said body.

3. A valve comprising:

a body defining a fluid channel including a first open end forming an inlet to said channel;

a valve seat within said body, said valve seat defining an outlet in fluid communication with said channel;

a valve head adapted to engage said valve seat to close said outlet from said fluid channel;

a lever connected to said valve head and adapted to pivot said valve head toward said valve seat to close said valve and to pivot said valve head away from said valve seat to open said valve upon movement of said lever; and a movement restricter connected to said body and positioned to restrict movement of said valve head in a direction for opening said valve, said restricter including a ring surrounding said lever, and a tab extending inwardly in said ring for engaging said valve head.

4. The valve of claim 3, said ring being removable from said body.

5. A valve comprising:

a body defining a fluid channel including a first open end forming an inlet to said channel;

a valve seat within said body, said valve seat defining an outlet in fluid communication with said channel;

a valve head adapted to engage said valve seat to close said outlet from said fluid channel;

a lever connected to said valve head and adapted to pivot said valve head toward said valve seat to close said valve and to pivot said valve head away from said valve seat to open said valve upon movement of said lever; and a movement restricter connected to said body and positioned to restrict movement of said valve head in a direction for opening said valve, said restricter positioned to engage said valve head.

6. The valve of claim 1, said restricter positioned to engage said lever.

7. The valve of claim 1, said restricter formed integrally with said body outwardly from said lever.

8. A valve comprising:

a body defining a fluid channel including a first open end forming an inlet to said channel;

a valve seat within said body, said valve seat defining an outlet in fluid communication with said channel;

a valve head adapted to engage said valve seat to close said outlet from said fluid channel;

a lever connected to said valve head and adapted to pivot said valve head toward said valve seat to close said valve and to pivot said valve head away from said valve seat to open said valve upon movement of said lever;

a movement restricter connected to said body and positioned to restrict movement of said valve head in a direction for opening said valve; and a tamper-evident seal connected to said restricter by frangible links.

9. The valve of claim 8, said tamper-evident seal having a blocking member for engaging said lever, said blocking member connected to said restricter by said frangible links.

10. The valve of claim of claim 9, including a loop between said blocking member and said restricter, said loop having a handle.

11. A valve comprising:

a body defining a fluid channel including a first open end forming an inlet to said channel;

a valve seat within said body, said valve seat defining an outlet in fluid communication with said channel;

a valve head adapted to engage said valve seat to close said outlet from said fluid channel;

a lever connected to said valve head and adapted to pivot said valve head toward said valve seat to close said valve and to pivot said valve head away from said valve seat to open said valve upon movement of said lever;

a movement restricter connected to said body and positioned to restrict movement of said valve head in a direction for opening said valve; and a valve membrane of flexible material having said valve head formed therein, said membrane further including flanks connected to said valve head and said body.

12. A valve comprising:

a body defining a fluid channel including a first open end forming an inlet to said channel;

a valve seat within said body, said valve seat defining an outlet in fluid communication with said channel;

a valve head adapted to engage said valve seat to close said outlet from said fluid channel;

a lever connected to said valve head and adapted to pivot said valve head toward said valve seat to close said valve and to pivot said valve head away from said valve seat to open said valve upon movement of said lever, said lever having wings connected to said valve head on opposite sides thereof; and a movement restricter connected to said body and positioned to restrict movement of said valve head in a direction for opening said valve.

13. The valve of claim 1, said valve head having an enlargement shaped to fit in said valve seat.

14. The valve of claim 1, including a valve membrane of flexible material having said valve head formed therein, said membrane connected to and forming a fluid tight seal between said body and said lever.

15. The valve of claim 1, said restricter positioned outwardly of said lever.

16. A valve comprising:

a hollow body defining a fluid channel including a first open end forming an inlet to said channel;

a valve seat within said body at a second end thereof, said valve seat defining an outlet in fluid flow communication with said channel;

a lever pivotally connected to said body;

a valve membrane of flexible material defining a valve head therein, said valve head being adapted to engage said valve seat to close said outlet from said fluid channel, said valve membrane connected to and forming a fluid tight seal between said body and said lever, said valve head and said lever operatively associated to pivot said valve head toward said valve seat to close said valve and to pivot said valve head away from said valve seat to open said valve upon movement of said lever; and a movement restricter connected to said body and disconnected from said valve head when said valve is closed, said restricted being adapted for restricting movement of said valve head in a direction to open said valve.

17. The valve of claim 16, said restricter positioned outwardly of said lever.

18. The valve of claim 16, said restricter positioned to engage said valve membrane and thereby restrict movement of said valve head.

19. A valve comprising:

a hollow body defining a fluid channel including a first open end forming an inlet to said channel;

a valve seat within said body at a second end thereof, said valve seat defining an outlet in fluid flow communication with said channel;

a lever pivotally connected to said body;

a valve membrane of flexible material defining a valve head therein, said valve head being adapted to engage said valve seat to close said outlet from said fluid channel, said valve membrane connected to and forming a fluid tight seat between said body and said lever, said valve head and said lever operatively associated to pivot said valve head toward said valve seat to close said valve and to pivot said valve head away from said valve seat to open said valve upon movement of said lever;

a movement restricter connected to said body for restricting movement of said valve head in a direction to open said valve; and a tamper-evident seal separably connected to said restricter.

20. The valve of claim 19, said tamper evident seal being connected to said restricter by frangible links.

21. A valve comprising:

a hollow body defining a fluid channel including a first open end forming an inlet to said channel;

a valve seat within said body at a second end thereof, said valve seat defining a downwardly opening outlet in fluid flow communication with said channel;

a lever pivotally connected to said body;

a valve membrane of flexible material defining a valve head therein, said valve head being adapted to engage said valve seat to close said outlet from said fluid channel, said valve membrane being connected to and forming a fluid tight seal between said body and said lever, said valve head and said lever operatively associated to pivot said valve head toward said valve seat to close said valve and to pivot said valve head away from said valve seat to open said valve upon movement of said lever, said valve membrane being formed in a shape having memory, and being positioned on said body for deflection from said shape to open said valve upon movement of said lever and for returning to said shape for closing said valve upon release of said lever; and a cap connected to said body and substantially covering said valve membrane, said cap including a portion thereof positioned to restrict movement of said valve head in a direction to open said valve.

22. The valve of claim 21, said portion of said cap including a tab positioned to engage said membrane.

23. The valve of claim 21, said portion of said cap being a wall disposed outwardly of said lever for restricting movement of said lever.

* * * * *